US009055771B2

(12) United States Patent
Deguchi et al.

(10) Patent No.: US 9,055,771 B2
(45) Date of Patent: Jun. 16, 2015

(54) BRASSIERE WITH EXCELLENT VIBRATION RESISTANCE

(71) Applicant: Asahi Kasei Fibers Corporation, Osaka-shi, Osaka (JP)

(72) Inventors: Junko Deguchi, Tokyo (JP); Yasushi Minari, Tokyo (JP); Yuji Yoshida, Tokyo (JP)

(73) Assignee: ASAHI KASEI FIBERS CORPORATION, Osaka-Shi (JP)

( * ) Notice: Subject to any disclaimer, the term of this patent is extended or adjusted under 35 U.S.C. 154(b) by 0 days.

(21) Appl. No.: 14/008,248

(22) PCT Filed: Dec. 14, 2012

(86) PCT No.: PCT/JP2012/082556
§ 371 (c)(1),
(2) Date: Sep. 27, 2013

(87) PCT Pub. No.: WO2013/089243
PCT Pub. Date: Jun. 20, 2013

(65) Prior Publication Data

US 2014/0287652 A1 Sep. 25, 2014

(30) Foreign Application Priority Data

Dec. 16, 2011 (JP) ..... 2011-276004
May 18, 2012 (JP) ..... 2012-114983
May 18, 2012 (JP) ..... 2012-115037
Aug. 30, 2012 (JP) ..... 2012-190587

(51) Int. Cl.
*A41C 3/00* (2006.01)
*A41C 3/12* (2006.01)

(52) U.S. Cl.
CPC ..... *A41C 3/12* (2013.01); *A41C 3/0057* (2013.01); *A41C 3/0021* (2013.01); *A41C 3/005* (2013.01)

(58) Field of Classification Search
USPC ..... 450/86, 59–61, 74–76, 83, 92
See application file for complete search history.

(56) References Cited

U.S. PATENT DOCUMENTS 2,666,919 A * 1/1954 Banister ..... 450/36
2,703,886 A * 3/1955 Lo Cascio ..... 450/59

(Continued)

FOREIGN PATENT DOCUMENTS

JP 62-203209 12/1987
JP 8-100308 4/1996

(Continued)

OTHER PUBLICATIONS

English-language International Search Report from the Japanese Patent Office mailed Mar. 19, 2013, for International Application No. PCT/JP2012/082556.

(Continued)

*Primary Examiner* — Gloria Hale
(74) *Attorney, Agent, or Firm* — Finnegan, Henderson, Farabow, Garrett & Dunner, L.L.P.

(57) ABSTRACT

To provide a brassiere with an excellent effect of reducing motion of the breasts during movement, or in other words, excellent vibration resistance, and preferably a brassiere that also has excellent beauty appearance and comfort. The brassiere comprises a pair of cup sections, a joint linking together the front center sides of the cup sections, wing sections, and straps whose edges are connected to the pair of cup sections and the wing sections, and having an anti-vibration section at a specific location.

15 Claims, 4 Drawing Sheets

(56) References Cited

U.S. PATENT DOCUMENTS

| | | | | | |
|---|---|---|---|---|---|
| 2,864,375 | A | * | 12/1958 | Steinmetz | 450/68 |
| 3,172,408 | A | * | 3/1965 | Sachs et al. | 450/59 |
| 3,566,878 | A | * | 3/1971 | Radomski | 450/65 |
| 3,746,008 | A | * | 7/1973 | LoCascio et al. | 450/74 |
| 4,432,364 | A | * | 2/1984 | Martini | 450/60 |
| 5,045,019 | A | * | 9/1991 | Capasso et al. | 450/74 |
| 6,918,812 | B2 | * | 7/2005 | Giese | 450/65 |

FOREIGN PATENT DOCUMENTS

| | | |
|---|---|---|
| JP | 2003-221705 | 8/2003 |
| JP | 2006-104613 | 4/2006 |
| JP | 2007-162146 | 6/2007 |
| JP | 2011-179144 | 9/2011 |

OTHER PUBLICATIONS

English-language International Search Report from the Japanese Patent Office mailed Mar. 19, 2013, for International Application No. PCT/JP2012/062556.

* cited by examiner

BRASSIERE WITH EXCELLENT VIBRATION RESISTANCE

TECHNICAL FIELD

The present invention relates to a brassiere that reduces motion of the breasts during activity when worn. More specifically, the invention relates to a brassiere with an effect of reducing motion of the breasts during activity when worn, i.e. vibration resistance, without impairing comfort or maintaining a beautiful appearance.

BACKGROUND ART

One of the major purposes of a brassiere is to maintain an attractive form for the breasts, but another important role is to minimize motion of the breasts during movement. Even when a brassiere is worn, however, the breasts often undergo a great deal of motion during walking or running. Such motion is very great particularly with large-sized breasts, and may not only be uncomfortable but can also contribute to hanging down of the breasts. Methods of attaching brassieres with strong wear pressure have been found to be effective for alleviating such motion, but the comfort during wear is notably impaired by such methods. Also, numerous types of sports bras have been developed as brassieres for alleviating motion of the breasts (PTLs 1 and 2). However, most sports bras have a design that covers the crevice between the breasts in order to minimize motion of the breasts during movement, and lacking a beautiful appearance, they are usually undesirable for ordinary day-to-day use.

There is demand for development of a brassiere that reduces motion of the breasts during moderate routine movements, with the crevice between the breasts opened wide and maintaining beauty appearance, and that also has suitable wear pressure.

PTL 3 proposes a technique for reducing motion of the breasts with a general-purpose brassiere. In this technique, a reinforcing section is provided in the upper cup section and in an oblique direction. In PTL 4, a plurality of tape members are disposed on a side cross.

CITATION LIST

Patent Literature

[PTL 1] Japanese Unexamined Patent Publication No. 2011-179144

[PTL 2] Japanese Unexamined Patent Publication No. 2006-104613

[PTL 3] Japanese Unexamined Patent Publication HEI No. 8-100308

[PTL 4] Japanese Unexamined Patent Publication No. 2007-162146

DISCLOSURE OF THE INVENTION

Problems to be Solved by the Invention

However, with only the reinforcing section described in PTL 3, the effect of reducing motion of the breasts has been insufficient, particularly for wearers with large cup sizes. Also, the tape member described in Cited document 4 is bonded to the sides of the bust through the side cross and functions to push the bust inward, but it has a poor function of inhibiting motion.

Thus, no brassiere can currently be found that is satisfactory in terms of the effect of reducing motion during movement, as well as beauty appearance and comfort.

The issue to be solved by the present invention is to provide a brassiere with an excellent effect of reducing motion of the breasts during movement, i.e. excellent vibration resistance, and preferably a brassiere that also has excellent beauty appearance and comfort in addition to vibration resistance.

Means for Solving the Problems

The present inventors have conducted much diligent research and experimentation aimed at solving this issue, and as a result have found that if a brassiere is provided with a specific reinforcer, it is possible to significantly improve motion of the breasts without covering the crevice between the breasts, and to form a comfortable brassiere without excessively increasing wear pressure, even for large cup sizes, and the invention has been completed upon this finding. More specifically, it was found that motion of the breasts can be improved by accomplishing the specific reinforcement at a location from the cup section through to the wing sections, the top edges of the cups, the bottom edges of the cups, the straps, or any combination of two or more of the foregoing. Specifically, the present invention provides the following.

[1] A brassiere comprising a pair of cup sections, a joint linking together the front center sides of the cup sections, wing sections, and straps whose edges are connected to the pair of cup sections and wing sections, and having one or more anti-vibration sections selected from the group consisting of the following (I) to (III):

(I) one or more selected from the group consisting of:

(1) a sub-wing section situated on the main body in a region from a portion of the cup section across to a portion of the wing section, wherein when the brassiere is situated so that a line segment extending from the bust top of the cup section to the back center of the wing section is longest, and a plane is defined having a normal in same direction as the line segment, joining sections are present between the sub-wing section and the main body, on a plane at a location 5% to 25% and on the plane at a location 50% to 90% on the line segment from the bust top toward the back center, and the sub-wing section has a region that is not joined to the main body, (2) an upper edge high-stress section in the cup section, the upper edge high-stress section extending along the top edge of the cup, the ratio S2/S1 between the expansion stress S2 of the upper edge high-stress section and the expansion stress S1 of the cup center section being between 2/1 and 400/1, and (3) a lower edge high-stress section in the cup section, the lower edge high-stress section extending along the cup lower edge, the ratio S3/S1 between the expansion stress S3 of the lower edge high-stress section and the expansion stress S1 of the cup center section being between 2/1 and 400/1;

(II) straps each with a mean cross-sectional area of 30 to 120 $mm^2$; and (III) a combination of (I) with straps each having a mean cross-sectional area of 25 to 120 $mm^2$.

[2] A brassiere according to [1] above, wherein the anti-vibration section comprises the sub-wing section.

[3] A brassiere according to [1] above, wherein the anti-vibration section comprises the upper edge high-stress section.

[4] A brassiere according to [1] above, wherein the anti-vibration section comprises the lower edge high-stress section.

[5] A brassiere according to [1] above, wherein the anti-vibration section comprises the strap, and the mean cross-sectional area of the strap is 30 to 120 $mm^2$.

[6] A brassiere according to [1] above, wherein the anti-vibration section comprises the upper edge high-stress section and the sub-wing section.

[7] A brassiere according to [1] above, wherein the anti-vibration section comprises the lower edge high-stress section and the sub-wing section.

[8] A brassiere according to [1] above, wherein the anti-vibration section comprises the strap and the sub-wing section, and the mean cross-sectional area of the strap is 25 to 1.20 $mm^2$.

[10] A brassiere according to [1] above, wherein the anti-vibration section comprises the strap and the lower edge high-stress section, and the mean cross-sectional area of the strap is 25 to 120 $mm^2$.

[11] A brassiere according to [1] above, wherein the anti-vibration section comprises the upper edge high-stress section and the lower edge high-stress section.

[12] A brassiere according to [1] above, wherein the anti-vibration section comprises the upper edge high-stress section, the lower edge high-stress section and the sub-wing section.

[13] A brassiere according to [1] above, wherein the anti-vibration section comprises the strap, the upper edge high-stress section and the sub-wing section, and the mean cross-sectional area of the strap is 25 to 120 $mm^2$.

[14] A brassiere according to [1] above, wherein the anti-vibration section comprises the strap, the lower edge high-stress section and the sub-wing section, and the mean cross-sectional area of the strap is 25 to 120 $mm^2$.

[15] A brassiere according to [1] above, wherein the anti-vibration section comprises the strap, the upper edge high-stress section and the lower edge high-stress section, and the mean cross-sectional area of the strap is 25 to 120 $mm^2$.

[16] A brassiere according to [1] above, wherein the anti-vibration section comprises the strap, the upper edge high-stress section, the lower edge high-stress section and the sub-wing sections, and the mean cross-sectional area of the strap is 25 to 120 $mm^2$.

[17] A brassiere according to any one of [1] to [16] above, wherein when the brassiere is situated so that the distance between the cup section front center side endpoints of the straps is maximal, the proportion of the area of the sections not covered by the structural material of the brassiere with respect to the area of a triangle formed by connecting the cup section front center side endpoints of the straps and the center bottom edge point of the joint, is at least 60%.

[18] A brassiere according to any one of [1] to [17] above, wherein the difference between the top bust dimension and the underbust dimension is 17.5 cm or greater.

[19] A brassiere according to any one of [11] to [18] above, wherein the maximum wear pressure is no greater than 50 HPa.

Effect of the Invention

The brassiere of the invention can reduce up/down motion (Y direction) and left/right motion (X direction), as well as back-and-forth motion (Z direction), of the breasts during movement. According to a specific mode of the invention, there can be provided a comfortable brassiere having a specific reinforcer, whereby it can reduce up/down motion (Y direction) and left/right motion (X direction), as well as back-and-forth motion (Z direction) of the breasts during movement, even with large cup sizes, without covering the crevice between the breasts, and has suitable constricting pressure. According to a preferred mode, it has a specific reinforcer, it has a specific strap, or it has a combination thereof, on at least the flank section, top edge or bottom edge of the cup, allowing it to exhibit a satisfactory effect of reducing motion. The invention can be suitably applied not only to ordinary brassieres but also to sports bras. According to the invention, the effect of reducing motion is particularly notable for large cup sizes.

BEST MODE FOR CARRYING OUT THE INVENTION

Figure 1:
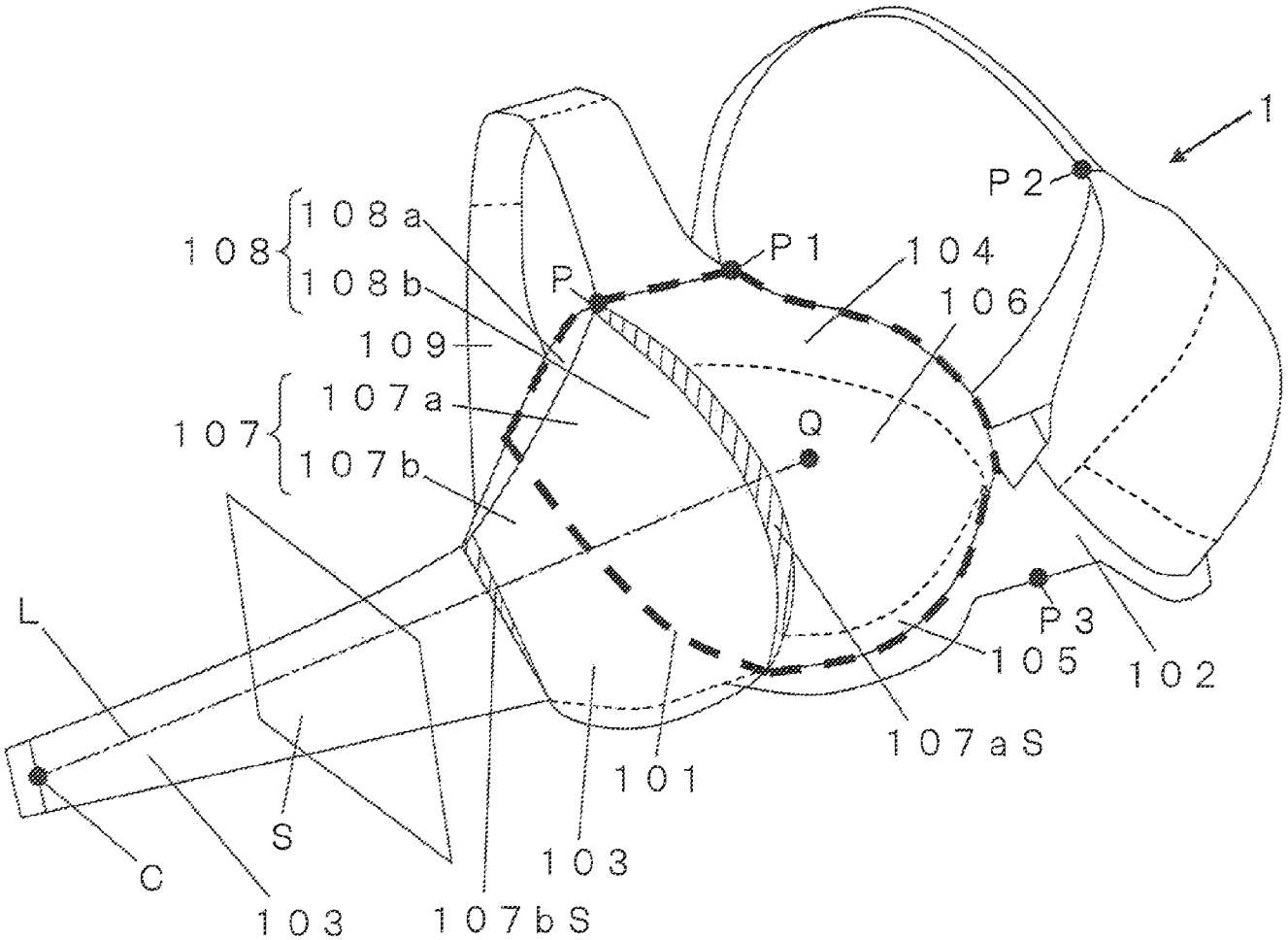
FIG. 1 is a schematic view showing an example of the structure of a brassiere of the invention.

The present invention will now be described in detail.

The invention provides a brassiere comprising a pair of cup sections, a joint linking together the front center sides of the cup sections, wing sections, and straps whose edges are connected to the pair of cup sections and the wing sections, wherein an anti-vibration section (also referred to herein as "reinforcer") at a specific location.

An example of the structure of the brassiere of the invention will now be explained with reference to FIGS. 1 to 3. The brassiere 1 of the invention comprises a pair of cup sections 101 (one of the pair being shown in the diagram as a region delineated by a dotted line), a joint 102 linking together the front center sides of the cup sections, and wing sections 103 (which are disposed on the flank sides of the cup sections 101 (i.e. the flank sides of the wearer)). The joint 102 may extend along the lower edges of the cup sections 101 as lower hem tape, for example, forming the bottom edge of the brassiere. Each wing section 103 extends toward the dorsal side of the wearer. The wing section 103 may have a base section 103*a* and a lower hem section 103*b* (for example, tape). Each of the members are composed of fabric. The edge of the brassiere further comprises straps 109 connected to the wing sections 103 and the pair of cup sections 101.

Figure 2:
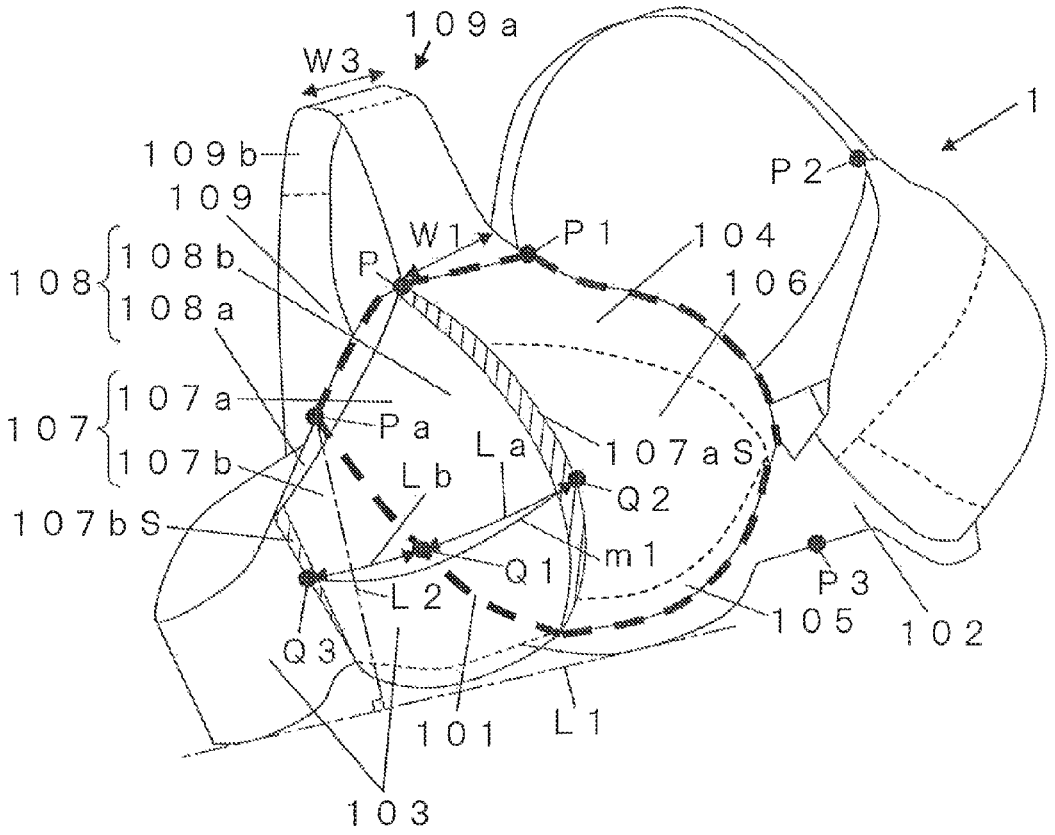
FIG. 2 is a schematic view showing an example of the structure of the front side of a brassiere of the invention.

Referring particularly to FIG. 1 and FIG. 2, the brassiere according to a specific mode has sub-wing sections as anti-vibration sections. According to a specific mode, when the brassiere is situated so that a line segment L connecting the bust top Q on each cup section with the back center C of the corresponding wing section, and a plane S is defined having a normal in the same direction as the line segment, each sub-wing section has a joining section between the sub-wing section and the main body, on a plane at a location 5% to 25% and on a plane at location 50% to 90% on the line segment L from the bust top Q toward the back center C, and the sub-wing section has a region that is not joined to the main body. According to the present disclosure, the back center is the point on the line corresponding to the back center of the wearer, which is at the center in the vertical direction of the wing section fabric. For example, when the wing section has a hook section, the back center is defined in the state with the hook section hooked. As regards the definitions of the shape and dimensions delineated using the "back center" for the purpose of the present disclosure, when multiple hook sections are present corresponding to multiple underbust sizes, the definitions should be considered satisfied if the back center is defined in a state with any one of the hook sections hooked.

According to a specific mode, the brassiere has an upper edge high-stress section extending along the upper edge of the cup (for example, the upper edge high-stress section 104 shown in FIG. 1).

According to a specific mode, the brassiere also has a lower edge high-stress section extending along the lower edge of the cup (for example, the lower edge high-stress section 105 shown in FIG. 1).

According to a specific mode, each strap as an anti-vibration section has a mean cross-sectional area of 30 to 120 $mm^2$.

Each member may be formed of separate fabrics, or they may be formed of a continuous fabric, and the borders between members defined only by shapes. In the latter case, the outer edge of the cup section is defined as the location of the edges, if the edges of the cup bulge are distinct, or as the location considered to be the edges from the shape of the bulge, if they are not distinct.

The brassiere of the invention has very excellent vibration resistance. The following method may be used to objectively evaluate the degree of motion.

The vibration resistance may be evaluated by a vibration test using a human analogue model. The procedure is typically as follows. The human analogue chest model used is a BUSTY AICHAN by At Planning Co., Ltd., or an equivalent model. When BUSTY AICHAN is used, the upper part of BUSTY AICHAN is clamped by two plastic gauges with approximately 35 cm lengths, and is clamped at uniform spacing with four vices and anchored with wires at holes appropriately opened in the chest section of a male M size chest mannequin. The sections other than the cups are also firmly anchored with strings or the like. The human analogue chest model is made of silicon and each has a top bust on the silicon portion (the length from the section where the bulge of the bust begins to the section where the bulge of the other bust begins) of 44 cm, an underbust of 24 cm, and a hardness of 0.5 to 0.8 as measured using a hardness meter with attachment of cellophane tape, and when fitted on the human body, it has a top bust of 104 cm and an underbust of 83 cm. The human analogue model is mounted on an apparatus that moves with up/down motion at a speed of 90 rpm in the vertical direction, with an amplitude of 20 cm. Examples of such apparatuses include a DeMattie apparatus, such as a leg oscillating apparatus by Kato Tech Corp. When the human analogue model does not fit inside the apparatus, a pulley or the like may be used to ensure an amplitude of 20 cm. Appropriate points are created on the bust section and the motion is measured by analyzing the behavior of movement of the points.

When the brassiere is not fitted, the maximum value of motion of the bust section during up/down motion at a speed of 90 rpm in the vertical direction with an amplitude of 20 cm is 34.1 cm. When the brassiere is fitted under these conditions the value of the motion is 22 cm to 25 cm, but it is even more preferably 22 cm to 24 cm from the viewpoint of more excellent vibration resistance.

The vibration resistance can be evaluated by the following method. The brassiere is worn by three participants with a body height of 160 cm±8 cm and a value of (top bust dimension−underbust dimension) of at least 17.5 cm, and they are asked to carry out light running activity on a treadmill at a speed of 6 km/h and a pace of 150 steps per minute, with one leg separated from the ground upon ground contact. During this time, a reflective sphere with a diameter of 1.8 cm is mounted on the clavicular part and the bust top part, and the reflective sphere is photographed for 20 seconds with two high-speed cameras. With light running for clavicular motion of 5 to 6 cm, as an index of motion of the breasts, the (maximum average)−(minimum average) (cm) for the value of (bust top motion)−(clavicular motion) (cm) during a period of 20 seconds are calculated in the three directions of width (X), length (Y) and depth (Z). The X direction is the direction of L1 described below, and the Y direction and Z direction are the respective perpendiculars to the X direction. The largest value of the values in the three directions is recorded as the motion during wear (cm), and it is divided by the value of (top bust dimension−underbust dimension) as the motion value. A motion value of 0.3 or smaller represents low motion, and is advantageous. The motion value is preferably no greater than 0.25, and more preferably no greater than 0.2. Although a smaller motion value is preferred, it is preferably 0.03 or greater and more preferably 0.05 or greater from the viewpoint of avoiding excessive compression and facilitating a satisfactory feel during wear.

Satisfactory vibration resistance that is measurable by this method can be achieved by situating on the brassiere one, or any combination of two or more, of the upper edge high-stress section, lower edge high-stress section, sub-wing section or strap having a specified mean cross-sectional area, i.e. reinforce.

The reinforcer will now be explained in detail.

The sub-wing section **108*b* is disposed on the main body in a region from a portion of the cup section 101 across to a portion of the wing section 103. The sub-wing section may be typically composed of one or more fabrics situated from the flank edge of the cup section 101 across to the wing section 103. The sub-wing section is not integrally formed with the body section 108*a*** at the cup section and wing section, but rather is formed over the body section by a separate fabric from the body section.

The sub-wing section and the main body typically have the following two joining sections.

The first joining section is preferably present on a plane S defined as explained above, at a location of 5% to 25%, preferably 8% to 25% and more preferably 10% to 23% on the line segment L, from the bust top Q toward the back center C. It is advantageous for the location of the first joining section to be at least 5% from the bust top toward the back center, as this will avoid large tensile force on the bust top. On the other hand, it is advantageous for the location of the joining section to be no greater than 25% from the bust top toward the back center, as this will facilitate the action of force pulling the bust toward the body side.

The second joining section is preferably present on the plane S, at a location of 50% to 90%, preferably 50% to 85% and more preferably 55% to 80% on the line segment L, from the bust top Q toward the back center C. It is advantageous for the location of the second joining section to be at least 50% from the bust top toward the back center, as this will facilitate application of tensile force on the bust top. On the other hand, it is advantageous for the location of the joining section to be no greater than 90% from the bust top toward the back center, as this will facilitate the action of force pulling the bust toward the body side.

The joining section between the sub-wing section and the main body may be present on a plane S defined as explained above, at a location 5% to 25% and on the plane at a location 50% to 90% on the line segment L from the bust top Q toward the back center C, and may also be present at a location other than on the plane. However, from the viewpoint of obtaining a more satisfactory vibration preventing effect by the sub-wing section, more preferably the joining section is not present on a plane S at a location, for example, greater than 25% and less than 50%, or a location of 25% to 55%, or a location of 23% to 60%, on the line segment L from the bust top toward the back center.

The border between the cup section and the wing section will normally be on a plane S at a location 25% to 35% on the line segment L from the bust top toward the back center. Thus, when the joining sections are present on planes at a location of 5% to 25% and a location of 50% to 90%, this is advantageous because the sub-wing section can be joined to the main body at the locations of the cup section and the wing section that are most preferred for vibration prevention.

The joining section between the sub-wing section and main body may be formed in a linear manner (typically as a belt with a prescribed width), or in a punctiform manner. For example, joining sections extending in a linear manner in basically the vertical direction may be formed on the left and right cup sections and the left and right wing sections. According to a preferred mode, the sub-wing section is joined to the body section at both a region on a portion of the cup section and a region on a portion of the wing section, and it has a region that is not joined to the body section. In the preferred mode, the sub-wing section 108*b* overlaps the body section 108*a* in a region that continuously runs across the region 107*a* as a portion of the cup section and the region 107*b* as a portion of the wing section. The sub-wing section 108*b* can form a flank reinforcer 107 composed of the region 107*a* and the region 107*b*. That is, the flank reinforcer 107 is formed by a joining fabric 108 composed of the body section 108*a* and the sub-wing section 108*b*.

According to a preferred mode, the sub-wing section is joined to the body section in a region containing both edges of the sub-wing section on the cup section side and the wing section side.

In the preferred mode, the sub-wing section is joined with a space between it and the body section. According to this mode, the sub-wing section may cover a region comprising at least a portion of the cup section of the body section and at least a portion of the wing section. The sub-wing section may be joined with the body section in a region containing at least a portion of the periphery of the sub-wing section (for example, both edges on the cup section side and the wing section side), or it may be joined with the body section only at the sections other than the periphery of the sub-wing section. The sub-wing section is joined with the body section so that a space is present between the sub-wing section and the body section. The space is the region where the sub-wing section and body section are not joined, sandwiched by the joining section or surrounded by the joining section. In order to form such a space, the joining section is preferably formed as a shape with two or more points or two or more lines. For example, an example of two or more points is a combination of one or more points within the region of the cup section and one or more points within the wing section. Also, an example of two or more lines is a combination of the joining section 107*a*S on the cup section side and the joining section 107*b*S on the wing section side, shown in FIGS. 1 and 2. For example, when two punctiform joining sections are to be formed, the space is the region of the sub-wing section connecting the two points and the region of the body section extending between the region connecting the two points. In the space, the sub-wing section and the body section may be in a non-joined state, or they may be in contact with each other. With such a construction, the difference in tensile stress between the sub-wing section fabric and the body section fabric produces a vibration preventing effect, since it can create tensile force between the joining sections during wear.

Referring to FIG. 1, according to a specific mode the sub-wing section 108*b* is joined with the body section 108*a* on both edges on at least the cup section side and the wing section side, or in other words, in a region containing both edges on the cup section side and the wing section side, while also having a region not joined with the body section 108*a*. In a preferred mode, as shown in FIG. 1, the body section 108*a* and the sub-wing section 108*b* are joined by only a joining section 107*a*S on the cup section side and a joining section 107*b*S on the wing section side, while the sub-wing section 108*b* is not joined with the body section 108*a* at the other regions. The presence of the sub-wing section causes stretching force to act from the cup side edge of the sub-wing section toward the wing side during wear, thereby exhibiting a vibration preventing effect.

As a percentage of the area of the sub-wing section in the region subjected to tensile force during wear, the area of the region not joined with the body section is preferably 30% or greater, more preferably 60% or greater and even more preferably 80% or greater from the viewpoint of obtaining a satisfactory vibration preventing effect, while from the viewpoint of firmly joining the sub-wing section with the body section, it is preferably no greater than 99.5%, more preferably no greater than 99% and even more preferably no greater than 98%. The area of the region subjected to tensile force during wear is the area of the sub-wing fabric present in the region between the crossline near the frontmost center and the crossline near the most backmost center, of the crosslines between the plane perpendicular to L1 and passing through the joining section, and the surface of the sub-wing section.

Referring to FIG. 2, a line segment L2 is imagined which prescribes the shortest distance from a straight line L1 drawn in contact with the lowermost edge of the brassiere to the boundary point Pa between the cup top edge and the cup flank edge. Of the crosslines between the plane passing through line segment L2 and perpendicular to line segment L2, and the fabric surface of the body section (the surface on the outer side as seen by the wearer), there is selected a crossline that has the maximum length within the region 107*a*, and the intersection of that crossline with the cup flank edge is denoted as Q1 while the intersection between the crossline and the edge of the cup side joining section 107*a*S on the flank reinforcer edge side is denoted as Q2, and the line segment between Q1 and Q2 on the crossline is denoted as line segment La. The intersection between the crossline and the edge of the wing side joining section 107*b*S on the flank reinforcer edge side is denoted as Q3. The line segment between Q2 and Q3 on the crossline is denoted as line segment Lb and the length of the line segment Lb is denoted as the length Wb of the region 107*b*.

Figure 3:
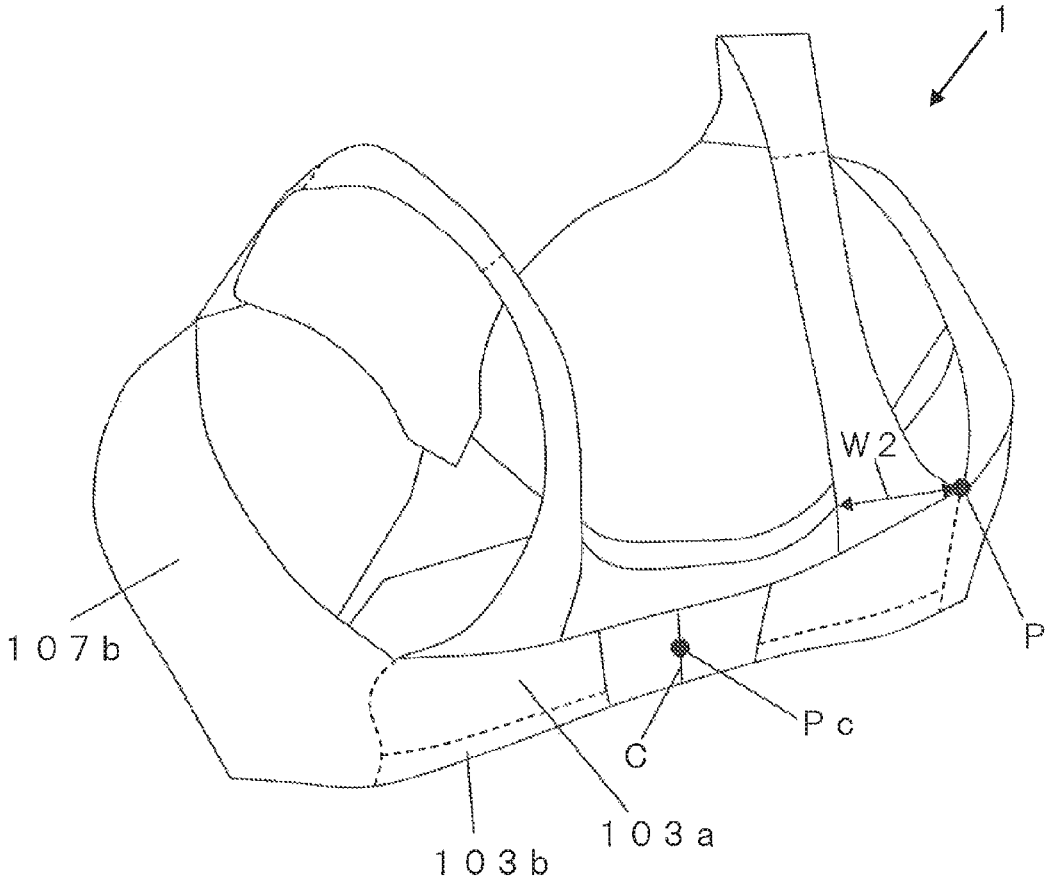
FIG. 3 is a schematic view showing an example of the structure of the back side of a brassiere of the invention.

The length of the wing section is the shortest length on the fabric from point Q1 to the back center of the wing section (point Pc in FIG. 3).

The length of the line segment L2 is suitably between 5 cm and 15 cm.

The sub-wing section length m1 is the shortest length within the fabric connecting point Q2 at the joining section with the body section, with point Q3. Also, the total length of line segment La and line segment Lb in the body section is denoted as the length m2 between joining sections on the body section. Normally, a brassiere is worn while being stretched to a degree of about 15%-25%. The sub-wing section length m1, the length m2 between the joining sections on the body section, and the stress on the fabrics of the sub-wing section and body section are preferably designed so that the desired vibration preventing effect is achieved at the desired elongation percentage.

If the main body elongation percentage during wear, i.e. {(underbust size)/(circumference at lowermost section of brassiere)×100}−100(%), is denoted as E2, while the sub-wing section elongation percentage for the sub-wing section which will apply the prescribed stress is denoted as E1, then the relationship represented by the following formula:

$$(1+E2/100)\times m2=(1+E1/100)\times m1$$

applies, and m1 is represented as:

$$m1=\{(1+E2/100)\times m2\}/(1+E1/100).$$

According to a specific mode, the brassiere is preferably designed by calculating the main body elongation percentage during wear so that the expansion stress of the body section fabric during wear is 2-4 N. It is preferred to use a fabric that produces expansion stress of 2-4 N during stretching, with any elongation percentage in the range of 15% to 25%. The expansion stress of the sub-wing section during wear is preferably set to be larger than the stress of the body section, it being more preferably 3-10 N during stretching with any elongation percentage in the range of 15% to 25%. If the expansion stress of the sub-wing section is 3 N or greater, the desired stress will be satisfactorily obtained and the vibration preventing effect will be satisfactory, while if it is no greater than 10 N, the sub-wing section will not be too tight and discomfort will not be experienced during wear. The relationship between the expansion stress and the elongation percentage can be set by measuring the elongation up to 22.1 N and determining the elongation corresponding to the desired set expansion stress, according to the cut strip Method A of JIS L1096.8.12.1. The expansion stress and elongation percentage are averages in the warp direction and weft direction of the fabric. The warp direction is set as desired, and the weft direction is the direction perpendicular to the warp direction.

The sub-wing section fabric does not necessarily need to be more resistant to elongation than the body section fabric, and by adjusting the lengths of m1 and m2 by the above formula depending on the ease of elongation of the sub-wing section, it is possible to increase the fitting effect of the brassiere on the skin, and exert tensile force on the cup side joining section of the sub-wing section during wear, thereby exhibiting a vibration preventing effect. From the viewpoint of satisfactorily exhibiting the desired elongation stress, the lengths of m1 and m2 each preferably do not deviate from the design values determined by the aforementioned formula by more than ±10%, ±8% or ±5%.

The height of the sub-wing section is represented as the length of a line segment (not shown) of the sub-wing section perpendicular to L1, with a larger height corresponding to a greater vibration preventing effect. Thus, the joining section on the cup section side preferably extends across both the top edge and the bottom edge of the cup, and the joining section on the wing side preferably extends across both the top edge and the bottom edge of the wing. At the sections other than the joining sections, the height of the sub-wing section is preferably equal to or greater than the height of the body section.

The sub-wing section contributes significantly to vibration resistance in the X and Z directions in particular, among motion in the X, Y and Z directions of the breast. That is, the sub-wing section has an excellent effect of increasing adhesiveness between the cup and breast and integrating them, and also has an effect of preventing bulging out of the breast during movement. The effect of increasing adhesiveness between the cup and the breast and integrating them is exhibited with particular effectiveness by vibration resistance in the Z direction, while the effect of preventing bulging out of the breasts is exhibited with particular effectiveness by vibration resistance in the X direction in which tensile force is being applied.

The elongation referred to here is elongation as a structural body including the lower hem tape, and it is the elongation when each section is stretched in the horizontal direction, i.e. the direction of L1. The elongation is measured according to the tensile test of cut strip method A of JIS L1096.8.12.1.

The sub-wing section may be composed of a fabric with lower elongation than the body section fabric, such as a cotton fabric, polyester woven or knitted fabric or polyamide material woven or knitted fabric, or of a fabric including spandex fibers and having a higher elongation than the body section fabric, such as a knitted fabric with a power net texture or a knitted fabric with a two-way texture. The friction force between the front side of the body section fabric and the back side of the sub-wing fabric can potentially influence the vibration preventing effect. Therefore, the friction force is preferably 0.10 to 0.20 and more preferably 0.12 to 0.18, when the friction force between them is evaluated using a KES-SE friction tester by Kato Tech Corp., for example, or an equivalent tester. If the friction force is 0.10 or greater it will be easier to satisfactorily exhibit the effect of the sub-wing fabric pressing against the main body fabric, and if it is no greater than 0.20 it will be easier to exhibit the effect of the sub-wing fabric pressing against the main body fabric, since the friction will not be too great. The friction force can be adjusted by combination of the body section fabric and the sub-wing section fabric.

The sub-wing section can be joined with the body section by stitching, welding or another method. For example, when the joining section of the sub-wing section with the body section is at both edges of the sub-wing section on the cup section side and the wing section side, the fabric for the body section and the fabric for the sub-wing section may be overlapped at both edges on the cup section side and the wing section side and anchored together by stitching, welding or another method to form the sub-wing section. When the cup section has two or more layers, joining may be with one of the layers, or joining may be with all of the layers. If the expansion stress of the fabric on the surface of the cup body section is low, the effect of fabric expansion and stretching of the cup is small with joining at only the surface fabric, and therefore joining and stitching to the cup section main body are preferably accomplished in such a manner that avoids expansion of only the surface fabric.

A separate example for the reinforcer is the upper edge high-stress section 104 of the cup. A vibration preventing effect can be exhibited by providing a high stress section on the top edge of the cup. The upper edge high-stress section is disposed running along the top edge of the cup. The upper edge high-stress section may constitute at least a portion of the substantial perimeter of the cup section.

According to a specific mode, the ratio S2/S1 of the expansion stress of the upper edge high-stress section 104 with respect to the expansion stress S1 of the center section 106 in the cup section is between 2/1 and 400/1. For the present disclosure, the center section of the cup is the region including the top section of the cup (that is, the location corresponding to the top of the bust of the wearer), and having single expansion stress. Unless otherwise specified, the "expansion stress" for the purpose of the present disclosure is the value obtained by measuring the stress at 10% elongation in the warp direction of the fabric (N/2.5 cm width, hereunder denoted simply as N) and the stress at 10% elongation in the weft direction (N), according to the tensile test of cut strip Method A of JIS L1096.8.12.1, and taking the average (hereunder referred to as "warp/weft mean expansion stress", or simply "expansion stress"). For the present disclosure, the warp direction of the fabric is any arbitrarily set direction, and the weft direction is the direction perpendicular to it.

When the cup section is composed of two or more layers (for example, the two layers of a urethane pad and a fabric), the expansion stress is measured with the two or more layers in a stacked state.

If the ratio S2/S1 is at least 2/1, the effect of reducing motion of the breasts by the high stress section will be significant. If the ratio S2/S1 is no greater than 400/1, on the other hand, the expansion stress at the high stress section will not be too high, and it will be possible to avoid resulting in a brassiere that is hard and difficult to fit. The ratio S2/S1 is preferably 3/1 to 100/1, more preferably 5/1 to 80/1 and most preferably 10/1 to 60/1.

The upper edge high-stress section contributes significantly to vibration resistance in the X and Y directions in particular, among motion in the X, Y and Z directions of the breast. With activities such as walking and running, the breasts held in the cups move up and down with some delay with respect to the up/down motion of the body. The up-and-down motion of the breasts in this case can be effectively reduced by providing an upper edge high-stress section. In addition to up/down motion of the body, activities such as walking and running also simultaneously generate left/right motion that rotates the body. Furthermore, if the upper edge high-stress section is provided running along the cup top edge, it will usually be possible to attach the upper edge high-stress section at a slight angle with respect to the horizontal direction. This can reduce motion of the breasts inward due to left/right motion, i.e. motion in the X direction.

The upper edge high-stress section is preferably disposed across a width of 0.5 to 5.0 cm at the top of the cup section. The width is more preferably 1.0 to 4.0 cm. The width may be designed in a discretionary manner. For example, the design may be such that the width of the upper edge high-stress section is narrow on the cup section at the front center side of the body of the wearer and wider at the flank sides.

A separate example for the reinforcer is the lower edge high-stress section 105 of the cup. A vibration preventing effect can be exhibited by providing a high stress section on the bottom edge of the cup. The lower edge high-stress section is disposed running along the bottom edge of the cup section. The lower edge high-stress section may constitute at least a portion of the substantial perimeter of the cup section.

According to a specific mode, the ratio S3/S1 of the expansion stress of the lower edge high-stress section 105 with respect to the expansion stress S1 of the center section 106 in the cup section is between 2/1 and 400/1. If the ratio S3/S1 is at least 2/1, the effect of reducing motion of the breasts by the high stress section will be significant. If the ratio S3/S1 is no greater than 400/1, on the other hand, the expansion stress at the high stress section will not be too high, and it will be possible to avoid resulting in a brassiere that is hard and difficult to fit. The ratio S3/S1 is preferably 3/1 to 100/1, more preferably 5/1 to 80/1 and most preferably 10/1 to 60/1.

The lower edge high-stress section contributes significantly to vibration resistance in the Y direction in particular, among motion in the X, Y and Z directions of the breast. With activity such as walking and running, the breasts held in the cups move up and down with some delay with respect to the up/down motion of the body. The downward beating motion of the breasts in this case can be effectively reduced by providing a lower edge high-stress section.

The lower edge high-stress section is preferably disposed across a width of 0.5 to 4.0 cm at the bottom of the cup section. The width is more preferably 1.0 to 3.0 cm. The width may be designed in a discretionary manner. For example, the design which is narrow on the front center side of the body of the wearer at the cup section and wider on the flank side, or a design with 1 to 2.5 cm on the front center side and 2.5 to 3.5 cm on the flank side.

When both an upper edge high-stress section and a lower edge high-stress section are to be provided, the percentage of the sum of the areas of the upper edge high-stress section and the lower edge high-stress section with respect to the area of the entire cup section is preferably 10% to 50% and most preferably 20% to 40%. If the percentage is at least 10% the reinforcing effect will be high, and a satisfactory effect of reducing motion of the breasts will be obtained even for large cups. If the percentage is no greater than 50%, on the other hand, it will be possible to satisfactorily avoid discomfort during wear. There is no particular restriction on the area ratio of the upper edge high-stress section and the lower edge high-stress section. The aforementioned percentage can be calculated, for example, by stacking thin paper on the cup surface and determining the mass of paper on the section corresponding to the area of each section of the cup.

The expansion stress of the upper edge high-stress section and the lower edge high-stress section is preferably 50 to 500 N, more preferably 100 to 400 N, even more preferably 120 to 350 N and most preferably 150 to 320 N. If the expansion stress is 50 N or greater, the reinforcing effect will be increased, and if it is no greater than 500 N, it will be possible to satisfactorily avoid discomfort during wear. There is no particular restriction on the ratio of expansion stress between the upper edge high-stress section and the lower edge high-stress section. Also, the expansion stress at the center section is preferably 0.5 to 50 N, more preferably 1 to 20 N, even more preferably 1.5 to 15 N and most preferably 2 to 10 N. If the expansion stress is 0.5 N or greater, the brassiere will be resistant to tearing and the like during wear and washing, and if it is no greater than 50 N, it will be possible to satisfactorily avoid discomfort during wear.

When an upper edge high-stress section and/or lower edge high-stress section is to be formed on the cup section, the fabric composing the center section and the separately prepared high expansion stress fabric for the high stress section, may be joined together or stacked and sewn together. Alternatively, one fabric partially provided with a high stress section may be used as the cup section. Reinforcement can be accomplished without impairing the outer appearance, by attaching or stitching a reinforcing fabric with high stress to the back side or an interlayer of the cup.

A different example of a reinforcer is a strap 109. According to a specific mode in which a strap is formed as the reinforcer, the mean cross-sectional area of the strap is 30 to 1.20 $mm^2$. This will allow vibration resistance to be satisfactorily achieved. The mean cross-sectional area is more preferably 35 to 100 $mm^2$. The cross-sectional area is the strap width (mm)×strap thickness (mm). The mean cross-sectional area is the number-average value of the cross-sectional area measured at both ends of the strap and at 10 equally divided sections between them. The mean cross-sectional area can be calculated, specifically, in the following manner.

Referring to FIG. 2 and FIG. 3, the mean cross-sectional area of the strap is the number-average value of the cross-sectional area calculated by width W1×thickness (not shown) for the edge (that is, the base section) of the cup section side (i.e. the front side) of the strap, the cross-sectional area calculated by width W2×thickness (not shown) of the edge (that is, the base section) of the wing section side (i.e. the back side), and the cross-sectional area calculated by each width× thickness for cross-sections at 10 equally divided sections (that is, nine cross-sections) in the lengthwise direction of the strap between the edge on the cup section side and the edge on the wing section side (for example, (width W3×thickness in FIG. 2). Incidentally, the width W1 and width W2 are the shortest distances from the connecting points P at the strap and the flank sides of the cup section and wing section, respectively, to the center side of the strap. When an adjustor that adjusts the length of the strap is provided, measurement is made with the length of the adjustor at maximum.

The weight of the breast is greatly exerted on the strap portion, and this force is very strong particularly in the case of large cup sizes. Thus, sports bras and brassieres with large cup sizes are modified to have increased strap widths. When the strap width is large, however, this reduces the degree of "sexiness" and impairs the beauty appearance. Even with a narrow strap width, the cross-sectional area of the strap can be increased to absorb vibration and stably support the cup section. When the mean cross-sectional area of the strap is smaller than 30 $mm^2$, the effect of absorbing vibration tends to be reduced. When the mean cross-sectional area of the strap is larger than 120 vibration is absorbed, but increasing the width impairs the beauty appearance, while increasing the thickness tends to causes problems such as a hard feel on the skin and effects on outer clothing. However, when the brassiere is reinforced at other locations as mentioned above, it is possible to maintain excellent vibration resistance for the brassiere if the mean cross-sectional area of the strap is, for example, at least about 80% of 30 $mm^2$. For example, if one or more upper edge high-stress sections, lower edge high-stress sections and/or sub-wing sections are provided, the mean cross-sectional area of the strap may be between 25 $mm^2$ and 120 $mm^2$.

The dorsal side attachment center of the strap is present at a location separated by preferably 25% to 60% and more preferably 30% to 50% of the length of the wing section, from the back center of the wing section toward the cup section side. A shift of at least 25% for the dorsal side attachment center of the strap from the back center of the wing section provides the advantage of excellent vibration resistance, while a shift of no greater than 60% provides the advantage of helping to keep the strap from sliding off. The length of the wing section is established as described above. The dorsal side attachment center of the strap, in FIG. 3, is the intersection between the normal drawn down from the center of the line segment of the width W2 to the line segment of the length of the wing section, and the line segment of the length of the wing section.

The power of the strap is measured by the elongation under a load of 0.5 $N/mm^2$ in the lengthwise direction, and it is preferably 30% to 80% and more preferably 40% to 70%. The elongation can be measured by a tensile test according to the cut strip Method A of JIS L1096.8.12.1, with the entire strap as the grip spacing, and the measuring load as the mean cross-sectional area multiplied by 0.5 N. If the power of the strap is at least 30%, it will be possible to avoid excessive hardness and satisfactorily inhibit vibration. If the power of the strap is no greater than 80%, it will be possible to avoid excessively large elongation and satisfactorily inhibit vibration.

The strap 109 preferably has a low stress section at one portion, with lower expansion stress than the other sections. By providing such a low stress section, it is possible to prevent concentration of wear pressure and increase comfort. Referring to FIG. 2, for example, the region containing the shoulder 109*a* preferably has a low stress section 109*b* with lower expansion stress than the other sections.

The strap contributes significantly to vibration resistance in the Y direction in particular, among motion in the X, Y and Z directions of the breast. The body experiences up/down motion during activities such as walking and running, and up/down motion of the breast held in the cup occurs with some delay, but if the cup is supported from above with a strap having at least a specified cross-sectional area, it is possible to minimize up/down motion of the breasts. Further attachment of a strap not near the center but rather near the flank side will significantly contribute to vibration resistance in the X direction, among motion of the breasts in the X, Y and Z directions. If a strap is attached near the flank side, this produces tensile force acting diagonally from above on the cup, and can effectively reduce rotating movement of the body during activities such as walking and running. The location of attachment of the strap is preferably a location where the front side is within 3 cm from the edge of the flank side of the cup mainly in the X direction and the back side is within 5 cm from the center point between the back center and the flank center (that is, intermediate between the front center and the back center) toward the flank side. Also, since the strap stretches the front of the cup toward the dorsal side of the body, it contributes to vibration resistance in the Z direction.

As explained above, the brassiere of the invention can exhibit a particularly notable vibration preventing effect when the reinforcer is a combination of one or more of a sub-wing section, an upper edge high-stress section on the cup, a lower edge high-stress section on the cup and a strap with a specific mean cross-sectional area. The vibration resistance can be increased even further particularly by a combination of vibration preventing effects in the X, Y and/or Z direction. For example, a sub-wing section and an upper edge high-stress section on the cup or a lower edge high-stress section on the cup, or a strap, or a combination of two or more of these, can reduce and disperse motion in the X, Y and Z directions, and is highly preferred. Also, when the reinforcer is a combination of two or more of a sub-wing section, an upper edge high-stress section on the cup, and lower edge high-stress section on the cup and a strap with a specific mean cross-sectional area, the lower limits for the preferred ranges of the characteristic values for each (especially the expansion stress ratio for the high stress section and the mean cross-sectional area of the strap) can be reduced by about 20%. For example, satisfactory vibration resistance can be obtained when the mean cross-sectional area of the strap is 30 to 120 $mm^2$, but when a reinforcer is also provided at other sections, as mentioned above, it functions as an anti-vibration section when it has a mean cross-sectional area of 25 to 120 $mm^2$.

Examples of preferred brassieres from this viewpoint will now be described.

(1) A brassiere having an upper edge high-stress section extending along the cup upper edge wherein the ratio S2/S1 of the expansion stress S2 of the upper edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(2) A brassiere having a lower edge high-stress section extending along the cup lower edge wherein the ratio S3/S1 of the expansion stress S3 of the lower edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(3) A brassiere with a strap mean cross-sectional area of 25 to 120 $mm^2$, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(4) A brassiere with a strap mean cross-sectional area of 25 to 120 $mm^2$, and having an upper edge high-stress section extending along the cup upper edge, the ratio S2/S1 of the expansion stress S2 of the upper edge high-stress section with respect to the expansion stress S1 of the cup center section being 2/1 to 400/1.

(5) A brassiere with a strap mean cross-sectional area of 25 to 1.20 $mm^2$, and having a lower edge high-stress section extending along the cup lower edge, the ratio S3/S1 of the expansion stress S3 of the lower edge high-stress section with respect to the expansion stress S1 of the cup center section being 2/1 to 400/1.

(6) A brassiere having an upper edge high-stress section extending along the cup upper edge, the ratio S2/S1 of the expansion stress S2 of the upper edge high-stress section with respect to the expansion stress S1 of the cup center section being 2/1 to 400/1, and having a lower edge high-stress section extending along the cup lower edge, the ratio S3/S1 of the expansion stress S3 of the lower edge high-stress section with respect to the expansion stress S1 of the cup center section being 2/1 to 400/1.

(7) A brassiere having an upper edge high-stress section extending along the cup upper edge wherein the ratio S2/S1 of the expansion stress S2 of the upper edge high-stress section with respect to the expansion stress S1 of the cup center section is 2/1 to 400/1, having a lower edge high-stress section extending along the cup lower edge wherein the ratio S3/S1 of the expansion stress S3 of the lower edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(8) A brassiere with a strap mean cross-sectional area of 25 to 1.20 $mm^2$, having an upper edge high-stress section extending along the cup upper edge wherein the ratio S2/S1 of the expansion stress S2 of the upper edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(9) A brassiere with a strap mean cross-sectional area of 25 to 120 $mm^2$, having a lower edge high-stress section extending along the cup lower edge wherein the ratio S3/S1 of the expansion stress S3 of the lower edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

(10) A brassiere with a strap mean cross-sectional area of 25 to 120 $mm^2$, having an upper edge high-stress section extending along the cup upper edge wherein the ratio S2/S1 of the expansion stress S2 of the upper edge high-stress section with respect to the expansion stress S1 of the cup center section is 2/1 to 400/1, and having a lower edge high-stress section extending along the cup lower edge wherein the ratio S3/S1 of the expansion stress S3 of the lower edge high-stress section with respect to the expansion stress S1 of the cup center section is 2/1 to 400/1.

(11) A brassiere with a strap mean cross-sectional area of 25 to 120 $mm^2$, having an upper edge high-stress section extending along the cup upper edge wherein the ratio S2/S1 of the expansion stress S2 of the upper edge high-stress section with respect to the expansion stress S1 of the cup center section is 2/1 to 400/1, having a lower edge high-stress section extending along the cup lower edge wherein the ratio S3/S1 of the expansion stress S3 of the lower edge high-stress section with respect to the expansion stress S1 of the cup center section is 2/1 to 400/1, and having a sub-wing section, such that when the brassiere is situated so that a line segment from the bust top on the cup section extending to the back center of the wing section is longest, and a plane S is defined having a normal in the same direction as the line segment, a joining section is present between the sub-wing section and the main body, on a plane at a location 5% to 25% and on a plane at location 50% to 90% on the line segment from the bust top toward the back center, and the sub-wing section has a region that is not joined to the main body.

Any two or more of the sub-wing section, the upper edge high-stress section of the cup and the lower edge high-stress section of the cup may contact or overlap at the edges. Also, preferably no high stress section is present near the center of the cup section (that is, near the top part of the bust of the wearer). This will make it possible to more satisfactorily realize breast shape retention with the cup, compared to when there is a reinforcer extending from the top section to the bottom section of the cup as described in PTL 3, for example.

Figure 4:
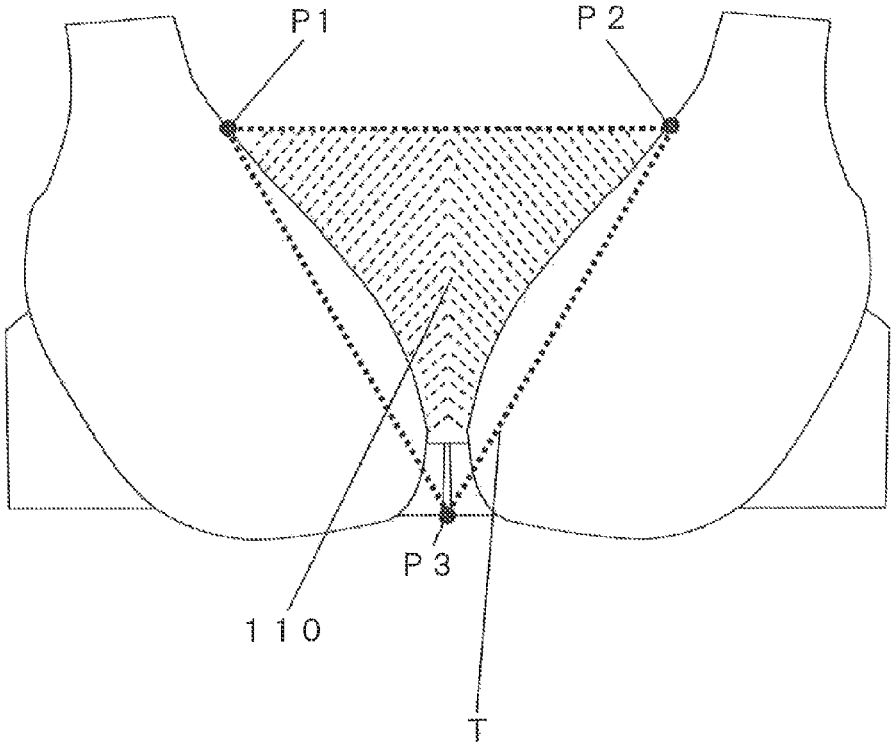
FIG. 4 is a schematic view illustrating the shapes of openings on the front of a brassiere of the invention.

Referring to FIG. 2 and FIG. 4, according to a specific mode, when the brassiere is situated so that the distance between the cup section front center side endpoints P1, P2 of the strap is maximal, the proportion of the area of the section 110 not covered by the brassiere structural material with respect to the area of a triangle T formed by connecting the cup section front center side endpoints P1, P2 of the strap and the center bottom edge point P3 of the joint, is preferably 60% or greater, more preferably 70% or greater, even more preferably 80% or greater and most preferably 100%. The triangle constitutes the section of the "crevice between the breasts". If this proportion is 60% or greater, it will be possible to prevent the crevice from being hidden and a satisfactory beauty appearance can be achieved. Since the brassiere of the invention can have the specific motion value mentioned above, obtained by having a specific reinforcer, for example, it is advantageous in that it has excellent vibration resistance even when in an "open" state where the aforementioned proportion is 60% or greater.

The brassiere of the invention preferably has a difference between the top bust dimension and the underbust dimension (also referred to herein as "top bust–underbust") of at least 17.5 cm, and more preferably the top bust–underbust value is at least 20 cm. There is no particular restriction on the upper limit for top bust–underbust, but it may be 35 cm or 30 cm, for example. A top bust–underbust value of at least 17.5 cm corresponds to D-cup or greater by Japan sizes, D or greater by American sizes, and C or greater by British sizes. A top bust–underbust value of at least 20 cm corresponds to E-cup or greater by Japan sizes, E or greater by American sizes, and D or greater by British sizes. According to the invention, it is possible to notably reduce motion of the breasts while maintaining beauty appearance, even with large cup sizes. The top bust dimension is the value of the circumference around the maximal portion of the bulge of the breast, while the underbust dimension is the value of the circumference of the bottom edge of the bulge of the breast.

According to a preferred mode, the maximum wear pressure of the brassiere of the invention is no greater than 50 HPa. For the purpose of the present disclosure, the maximum wear pressure is the maximum of the wear pressure between the brassiere and the wearer while wearing the brassiere. The maximum wear pressure can be measured by the following method, specifically. That is, the wear pressure is measured with a multi-point contact pressure gauge at seven locations: (1) the section corresponding to below the flank section of the wearer, (2) the section corresponding to near the bottom edge of the bulge of the bust of the wearer, (3) the shoulder center section of the strap, (4) the back side base section of the strap, (5) above the cup section, (6) the flank section of the cup section and (7) below the cup section. The highest value among the obtained values is recorded as the maximum wear pressure. Location (1) is the lower hem tape flank section, for example, when lower hem tape is used. Location (2) is the cup center bottom section of the lower hem tape (that is, the area near the section in contact with the straight line L1 in FIG. 2), for example, when lower hem tape is used. Also, location (5) refers to the region indicated as the upper edge high-stress section 104 in FIG. 2, location (6) refers to the region indicated as region 107*a* in FIG. 2, and location (7) refers to the region indicated as the lower edge high-stress section 105 in FIG. 2.

The brassiere of the invention can have the specific motion value mentioned above by, for example, providing a specific reinforcer. Thus, since the wear pressure at each location can be limited to no greater than 50 HPa while minimizing motion of the breasts, it is possible to reduce the maximum wear pressure for the present disclosure to no greater than 50 HPa, and to avoid the discomfort of constriction during wear. It is generally common to increase constriction in order to minimize motion of the breasts, and numerous brassieres have very high wear pressure especially on the shoulders. However, when the wear pressure on sections of a brassiere exceed 50 HPa, this generally tends to cause discomfort. According to the invention, movement of the breasts in the X, Y and Z directions is reduced and dispersed by a low motion value, and concentration of wear pressure can be prevented. The dispersion effect on wear pressure is particularly excellent with the aforementioned strap reinforcement. The maximum wear pressure is more preferably no greater than 45 HPa and even more preferably no greater than 40 HPa. On the other hand, the maximum wear pressure is also preferably 10 HPa or greater, more preferably 13 HPa or greater and even more preferably 15 HPa or greater, from the viewpoint of minimizing shifting during wear and more easily obtaining a low motion value.

The brassiere of the invention comprises a pair of cup sections, a joint linking together the front center sides of the cup sections, and wing sections, and as mentioned above, these may be formed of a single fabric, and even the entire brassiere including the strap may be formed of a single fabric. With such a brassiere, the reinforcer may be suitably formed by stacking a separate fabric on the back side of the brassiere (that is, on the wearer side). For example, there may be used a method of stitching or bonding a reinforcing fabric to the back side of the brassiere. For the strap, there may be suitably used a method of increasing the width of the section where the strap is attached to the cup section and wing section by design, with a single fabric, or a method of attaching a reinforcing fabric to the back side of the strap to increase the thickness of the strap.

There are no particular restrictions on the material for each member of the brassiere of the invention, and there may be suitably used synthetic fibers such as polyester-based fibers or polyamide-based fibers, cellulose-based fibers such as rayon, cupra or acetate, and natural fibers such as cotton and hemp. There are no particular restrictions on the structure of the fabric(s) composing each member, and there may be used a knitted fabric, woven fabric, nonwoven fabric, or the like. Textured yarns may also be used. According to the invention, it is effective to provide a fabric with appropriate stretching properties for each member. For each member there is preferably used a knitted fabric with elongation properties, mixed knitted with spandex. Also, the fabrics used for the cup section and wing section may be double circular knits, tricot knits, rashel knits or the like, with tricot half-knit fabrics being preferably used. The knitting gauge of the knitting machine used is preferably about 20 to about 40 GG. Also, a woven fabric or warp insertion warp-knitted fabric or the like is preferably used in the high stress section, while lace with slight elongation has excellent design properties and is thus highly preferred for use.

Each member can be formed of monofilaments or multifilaments. Multifilaments may contain a delustering agent such as titanium dioxide, a stabilizer such as phosphoric acid, an ultraviolet absorber such as a hydroxybenzoptenone derivative, a crystallization nucleating agent such as talc, a lubricity aid such as AEROSIL, an antioxidant such as a hindered phenol derivative, or a flame retardant, antistatic agent, pigment, fluorescent whitening agent, infrared absorber, antifoaming agent or the like.

The total denier of the fabric material composing each member of the brassiere of the invention may be in a range commonly used for clothing and the like. From the viewpoint of strength and softness, the total denier is preferably between about 22 and about 700 dtex.

The basis weight of the fabric used for each member is not particularly restricted but is preferably between about 50 and about 500 g/m$^2$.

Also, the fabric used for each member is preferably subjected to water absorption treatment.

A urethane pad with a thickness of 2-15 mm is preferably used in the cup sections, and it is preferred to increase the air permeability by using a three-dimensional knitted fabric in the cup sections.

EXAMPLES

The invention will now be explained in greater detail by examples. Naturally, the invention is not limited to the examples. The brassieres obtained in the examples and comparative examples were evaluated in the following manner.

(1) Expansion Stress of Fabric of Each Member

The stress of the fabric sample was measured according to the cut strip Method A of JIS L1096.8.12.1. The stress property at 10% elongation was calculated as the average value upon measuring the stress at 10% elongation in the warp direction and stress at 10% elongation in the weft direction (per 2.5 cm width).

Test strip width: 2.5 cm

Test strip clamping length: 10 cm

Stretching speed: 30 cm/min

The fabric sample of each member was measured under the conditions described above, but the length was appropriately modified in cases where the clamping length of the test strip could not be obtained. When the width of the test strip could not be obtained, the width was appropriately modified and the resulting stress value was calculated as a numerical value per 2.5 cm width.

(2) Stress and Elongation of Fabrics of Body Section and Sub-Wing Section

The elongation up to 22.1 N was measured according to the cut strip Method A of JIS L1096.8.12.1, and the elongation corresponding to the set stress was determined.

(3) Power of Strap

The stress property of the strap during elongation was measured according to the cut strip Method A of JIS L1096.8.12.1. A load of 0.5 (N)×cross-sectional area (mm$^2$) was applied in the warp direction of the strap, and the ductility (%) was measured.

Test strip clamping length: 10 cm

Stretching speed: 30 cm/min

The fabric sample of each member was measured under the conditions described above, but the length was appropriately modified in cases where the clamping length of the test strip could not be obtained. When the width of the test strip could not be obtained, the width was appropriately modified for measurement.

(4) Friction Between Body Section and Sub-Wing Section

The friction force between them was evaluated with a KES-SE friction tester by Kato Tech Corp. The fabric for the brassiere body section was set on the apparatus main frame, the fabric of the sub-wing section was attached to the friction block in such a manner as to rub the body section-contacting side, a 50 g load was applied, and the friction coefficient was measured. The friction direction coincided with the direction of stretching during wear.

(5) Motion Value by Measurement with Human Analogue Model

The human analogue chest model used was BUSTY AICHAN by At Planning Co., Ltd., with the upper part of BUSTY AICHAN clamped by two plastic gauges with approximately 35 cm lengths, and clamped at uniform spacing with four vices and anchored with wires at holes opened in the chest section of a male M size chest mannequin. The sections other than the cups were firmly anchored with strings. The human analogue chest model were made of silicon and each had a top bust on the silicon portion (the length from the section where the bulge of the bust begins to the section where the bulge of the other bust begins) of 44 cm, an underbust of 24 cm, and a hardness of 0.6 as measured using a hardness meter with attachment of cellophane tape, and when fitted on the human body, it had a top bust of 104 cm and an underbust of 83 cm. The human analogue model was mounted on a leg stretching apparatus by Kato Tech Corp., that moves with up/down motion at a speed of 90 rpm in the vertical direction, with an amplitude of 20 cm. Points were created in the bust section (the top bust and the sections not held by the cup), and behavior of movement of the points was analyzed to measure the motion. When the brassiere was not fitted, the maximum value of motion of the bust section during up/down motion at a speed of 90 rpm in the vertical direction with an amplitude of 20 cm was 34.1 cm. The motion value was measured under these conditions.

(6) Motion Value During Wear

The brassiere was worn by three participants with a body height of 160 cm±8 cm and a brassiere size of 38DD (British size) based on (top bust−underbust), and they were asked to carry out light running activity on a treadmill at a speed of 6 km/h and a pace of 150 steps per minute, with one leg separated from the ground upon ground contact. During this time, a reflective sphere with a diameter of 1.8 cm was mounted on the clavicular part and the bust top part, and the reflective sphere was photographed for 20 seconds with two high-speed cameras (200 frames/sec). The clavicular motion was 5 to 6 cm. Using motion of the breasts during wear as an index, the (maximum average)−(minimum average) (cm) for the value of (bust top motion)−(clavicular motion) (cm) during a period of 20 seconds was calculated, and the value in the direction that was the largest of the values in the weft (X), warp (Y) and depth (Z) was taken as the motion (cm) during wear and was divided by (top bust−underbust) as the motion value. The average was calculated for the results of the three participants.

(7) Maximum Wear Pressure

A multi-point contact pressure gauge (AMI3037-10) by AMI Techno Co., Ltd. was used to measure the wear pressure, inserting a sensor between the wearer and the brassiere at the lower hem tape flank section, the lower center of the lower hem tape in the left-right direction of the cup, the strap shoulder center section, the strap back side base section, the section above the cup, the cup flank section and the section below the cup, while the brassiere was being worn, and the maximum of the obtained values was recorded as the maximum wear pressure (Pa).

(8) Comfort and Beauty Appearance

Comfort

Evaluation was made on the following scale during the wearing test of (6), and the monitor evaluations were averaged.

5: Virtually no sense of pressure, very comfortable.

4: Low sense of pressure, comfortable.

3: Some sense of pressure but not uncomfortable.

2: Sense of pressure and discomfort.

1: Strong sense of pressure, very uncomfortable.

Beauty Appearance

Evaluation was made on the following scale during the wearing test of (6), and the monitor evaluations were averaged.

5: Very beautiful outer appearance of chest when worn.

4: Beautiful outer appearance of chest when worn.

3: Neither beautiful nor unattractive.

2: Somewhat unattractive outer appearance of chest when worn.

1: Unattractive outer appearance of chest when worn.

Example 1

A brassiere of British size 38DD (corresponding to Japan size E85) (the difference between the top bust dimension and the underbust dimension being 20 cm, and the length of the line segment L being 30.5 cm when the brassiere was situated so that the line segment L from the bust top to the back center was longest) was produced having the shape shown in FIGS. 1 and 2, by the following method.

A urethane molded article with a thickness of 5 mm and a 10% warp/weft mean expansion stress of 3.0 N was bonded with a nylon 56 dtex/polyurethane 44 dtex 28 GG two-way tricot knitted fabric (fabric with a 10% warp/weft mean expansion stress of 0.4 N) and molded to produce a cup section 101. The 10% warp/weft mean expansion stress of the entire cup section was 3.7 N. The same two-way tricot knitted fabric was also used for the wing sections 103, and for the lower hem tape there was used 1 cm-wide rashel tape with a warp/weft mean expansion stress of 1.7 N.

From the back center of the wing section (the hook location where the underbust was minimum) to the cup section side, there is further provided a sub-wing section 107 formed of a plain weave fabric using #40 cotton yarn, so that the joining section with the main body is at a location 15% (which is in the cup section) and a location 70% (which is in the wing section) from the bust top toward the back center of the wing section, a plane S being defined matching the normal direction with respect to the direction of a line segment connecting the bust top Q on one side of the cup section with the back center C of the wing section. In this example of the brassiere, the border between the cup section and the wing section will normally be on the plane S at a location 30% from the bust top toward the back center. The joining section was formed with a shape indicated by the joining section 107*a*S on the cup section side and the joining section 107*b*S on the wing section side in FIG. 2, extending from the top edge across to the bottom edge of the main body. The sub-wing section and the main body are bonded by being stacked and sewn. The knitted fabric of the wing section was designed for an expansion stress of 2.5 N at an elongation percentage of 20% during wear, and the plain weave fabric was designed for an expansion stress of 4.0 N at an elongation percentage of 6% during wear. Since the elongation of the wing section at 22.1 N was 92%, the length of the sub-wing section was length m2 of the body section (i.e. La+Lb)+13% at the flank reinforcer. A wire covering the fabric was attached below the cup section. The strap was formed of a woven fabric using a 640 dtex polyurethane yarn double-covered with 70 dtex nylon textured yarn (draft: 3.5) and a 155 dtex nylon textured yarn in a single alternating arrangement as the warp yarn and a 155 dtex nylon textured yarn as the weft yarn. The width was 1.5 cm and the thickness was 1.4 mm (that is, the mean cross-sectional area was 21 $mm^2$), and it was attached so that the dorsal side attachment center of the strap was present at a location separated by 40% of the length of the wing section, from the back center of the wing section (at the location of the hook where the underbust is smallest) toward the cup section side. The power of the strap in the lengthwise direction was 62% at the shoulder center section. The vibration preventing effect against motion of the breasts was significant when the produced brassiere was worn, the maximum value of the wear pressure was low, and the comfort was excellent. Also, 80% of the area of a triangle formed by connecting the cup section front center side endpoints P1, P2 of the strap and the front center bottom edge point P3 of the joint was not covered by the brassiere structural material, and the beauty appearance was also excellent.

Example 2

A brassiere was produced and subjected to a wearing test in the same manner as Example 1, except that on the top edge of the cup section 101 of Example 1 there was stacked and stitched a reinforcing fabric which was a plain weave fabric using 3 cm-wide #40 cotton yarn and having a 10% warp/weft mean expansion stress of 170 N, to form the upper edge high-stress section 104, and no sub-wing section was attached.

Example 3

A brassiere was produced and subjected to a wearing test in the same manner as Example 1, except that on the bottom edge of the cup section 101 of Example 1 there was stacked and stitched a reinforcing fabric which was a plain weave fabric using 2 cm-wide #30 cotton yarn and having a 10% warp/weft mean expansion stress of 210 N, to form the lower edge high-stress section 105, and no sub-wing section was attached.

Example 4

A brassiere was produced and subjected to a wearing test in the same manner as Example 1, except that no sub-wing section was attached, for the strap 109 the woven fabric was produced using a 640 dtex polyurethane yarn double-covered with 155 dtex nylon textured yarn (draft: 3.5) and a 155 dtex nylon textured yarn in a single alternating arrangement as the warp yarn and a 210 dtex nylon textured yarn as the weft yarn, the edge widths W1 and W2 were 2.5 cm, the shoulder center section (shoulder) width W3 was 1.8 cm and the strap thickness was 1.8 mm (the number-average value for the cross-sectional area of each section with 10 equally divided sections in the lengthwise direction of the strap was 35 $mm^2$, and the power in the lengthwise direction of the strap was 49% at the shoulder center section),

Example 5

The sub-wing section was formed joining the main body at a location 10% (which is in the cup section) and a location 80% (which is in the wing section) from the bust top toward the back center of the wing section, a plane being defined matching the normal direction with respect to the direction of a line segment connecting the bust top on one side of the cup section with the back center of the wing section. As the sub-wing section, nylon 78 dtex/polyurethane 310 dtex power net knitted fabrics were stacked and sewn on both edges on the cup section side and the wing section side, to form a flank reinforcer 107. The knitted fabric of the wing section was designed for expansion stress of 3 N with an elongation percentage of 20% during wear, the power net knitted fabric was designed for expansion stress of 4.5 N with an elongation percentage of 40%, and the length of the sub-wing section was −14% of the length of the body section of the flank reinforcer. A brassiere was produced and subjected to a wearing test in the same manner as Example 1, except that on the top edge of the cup section 101 there was stacked and stitched a reinforcing fabric which was a plain weave fabric using 2.5 cm-wide #40 cotton yarn and having a 10% warp/weft mean expansion stress of 170 N, to form the upper edge high-stress section 104.

Example 6

A brassiere was produced and subjected to a wearing test in the same manner as Example 1, except that as the cup section-covering fabric of Example 1 there was used a nylon 22 dtex/polyurethane 22 dtex 32 GG two-way tricot fabric having a warp/weft mean expansion stress of 0.11 N, and as a 2 cm-wide reinforcing fabric on the bottom edge of the cup section 101 there was used a warp knitted fabric in which 660 dtex polyester yarn was inserted in a 560 dtex polyester chain stitch, having a 10% warp/weft mean expansion stress of 210 N, to form the lower edge high-stress section 105.

Example 7

A brassiere was produced and subjected to a wearing test in the same manner as Example 1, except that for the strap there was produced a woven fabric using a 640 dtex polyurethane yarn double-covered with a 70 dtex nylon textured yarn (draft: 3.5) and a 155 dtex nylon textured yarn in a single alternating arrangement as the warp yarn and a 1.55 dtex nylon textured yarn as the weft yarn, the edge widths W1 and W2 were 3.5 cm, the shoulder center section (shoulder) width W3 was 2 cm and the strap thickness was 1.6 mm (the mean cross-sectional area of 1.5 the strap was 37 $mm^2$, and the power in the lengthwise direction of the strap was 55% at the shoulder center section).

Example 8

A brassiere was produced and subjected to a wearing test in the same manner as Example 2, except that on the bottom edge of the cup section 101 of Example 2 there was stacked and stitched a reinforcing fabric which was a plain weave fabric using 2 cm-wide #30 cotton yarn and having a 10% warp/weft mean expansion stress of 210 N, to form the lower edge high-stress section 105, and no sub-wing section was attached.

Example 9

A brassiere was produced and subjected to a wearing test in the same manner as Example 2, except that for the strap there was produced a woven fabric using a 640 dtex polyurethane yarn double-covered with a 70 dtex nylon textured yarn (draft: 3.5) and a 155 dtex nylon textured yarn in a single alternating arrangement as the warp yarn and a 155 dtex nylon textured yarn as the weft yarn, the edge widths W1 and W2 were 2.5 cm, the shoulder center section (shoulder) width W3 was 1.6 cm and the strap thickness was 1.6 mm (the mean cross-sectional area of the strap was 28 $mm^2$, and the power in the lengthwise direction of the strap was 60% at the shoulder center section).

Example 10

A brassiere was produced and subjected to a wearing test in the same manner as Example 3, except that for the strap 109 there was produced a woven fabric using a 640 dtex polyurethane yarn double-covered with a 155 dtex nylon textured yarn (draft: 3.5) and a 155 dtex nylon textured yarn in a single alternating arrangement as the warp yarn and a 210 dtex nylon textured yarn as the weft yarn, the edge widths W1 and W2 were 2.5 cm, the shoulder center section (shoulder) width W3 was 1.8 cm and the strap thickness was 1.8 mm (the mean cross-sectional area of the strap was 35 $mm^2$, and the power in the lengthwise direction of the strap was 49% at the shoulder center section).

Example 11

A brassiere was produced and subjected to a wearing test in the same manner as Example 5, except that on the bottom edge of the cup section 101 of Example 5 there was stacked and stitched a reinforcing fabric which was a plain weave fabric using 2 cm-wide #30 cotton yarn and having a 10% warp/weft mean expansion stress of 210 N, to form the lower edge high-stress section 105, and no sub-wing section was attached.

Example 12

A brassiere was produced and subjected to a wearing test in the same manner as Example 5, except that in the brassiere of Example 5, for the strap there was produced a woven fabric using a 640 dtex polyurethane yarn double-covered with a 70 dtex nylon textured yarn (draft: 3.5) and a 155 dtex nylon textured yarn in a single alternating arrangement as the warp yarn and a 155 dtex nylon textured yarn as the weft yarn, the edge widths W1 and W2 were 3.5 cm, the shoulder center section (shoulder) width W3 was 2 cm and the strap thickness was 1.6 mm (the mean cross-sectional area of the strap was 37 $mm^2$, and the power in the lengthwise direction of the strap was 55% at the shoulder center section)

Example 13

A brassiere was produced and subjected to a wearing test in the same manner as Example 6, except that in the brassiere of Example 6, for the strap there was produced a woven fabric using a 640 dtex polyurethane yarn double-covered with a 70 dtex nylon textured yarn (draft: 3.5) and a 155 dtex nylon textured yarn in a single alternating arrangement as the warp yarn and a 155 dtex nylon textured yarn as the weft yarn, the edge widths W1 and W2 were 3.5 cm, the shoulder center section (shoulder) width W3 was 2 cm and the strap thickness was 1.6 mm (the mean cross-sectional area of the strap was 37 $mm^2$, and the power in the lengthwise direction of the strap was 55% at the shoulder center section).

Example 14

A brassiere was produced and subjected to a wearing test in the same manner as Example 11, except that in the brassiere of Example 11, for the strap there was produced a woven fabric using a 640 dtex polyurethane yarn double-covered with a 70 dtex nylon textured yarn (draft: 3.5) and a 155 dtex nylon textured yarn in a single alternating arrangement as the warp yarn and a 155 dtex nylon textured yarn as the weft yarn, the edge widths W1 and W2 were 3.5 cm, the shoulder center section (shoulder) width W3 was 2 cm and the strap thickness was 1.6 mm (the mean cross-sectional area of the strap was 37 $mm^2$, and the power in the lengthwise direction of the strap was 55% at the shoulder center section).

Example 15

The pattern of Example 5 was changed, so that the proportion of area of the section not covered by the brassiere structural material constituted 58% of the area of the triangle. The average value for the motion of the breasts during wear was very small at 1.5 cm, which was excellent vibration resistance, while the maximum wear pressure was 4.1 HPa which was comfortable, but a significant portion of the crevice between the breasts was covered and the beauty appearance was somewhat inferior to that of Example 5.

Example 16

A cup section was formed by sandwiching a 5 mm sponge sheet between two fabrics with a 10% warp/weft mean expansion stress of 0.5 N, which were nylon 56 dtex/polyurethane 44 dtex 28 GG double Denbigh knitted fabrics, at the cup section and bonding them, and then molding at 190° C., and a single brassiere was also produced according to FIG. 2. The 10% warp/weft mean expansion stress of the entire cup section was 2.8 N. For the lower hem tape there was used 1 cm-wide rashel tape with a warp/weft mean expansion stress of 1.7 N. The strap continued smoothly from the cup, the width near the base being about 5 cm and the width at the center section being 2 cm, and a reinforcing fabric which was a plain weave fabric using 3 cm-width #40 cotton yarn having a 10% warp/weft mean expansion stress of 170 N was stacked and sewn onto the back side of the top edge of the cup. No sub-wing section was provided.

Example 17

For reinforcement of the cup section of Example 2 there was used a raschel knitting machine (RSE6EL 28G raschel knitting machine by Meyer Co., Ltd.), there were arranged front nylon 110/48 (50 in, 250 out), middle nylon 56/48 in all-in, and back spandex 44 (POICA SF type by Asahi Kasei Fibers Corp.) in all-in, forming a double Denbigh with the middle and back, and looping the front bob with a single needle (denbigh), and the reed was moved in the oblique direction along the line of the upper edge high-stress section having the same shape as Example 2 to form a knitted fabric, for integral formation of the upper edge high-stress section with the other sections of the cup section. The finishing was accomplished by a common method, and after dyeing, it was cut along the section of low ductility and a cup was used. The brassiere was otherwise produced in the same manner as Example 2, and subjected to a wearing test.

Example 18

A brassiere was produced in the same manner as Example 1, except for the following changes. The fabric used for the sub-wing section was the same nylon 56 dtex/polyurethane 44 dtex 28 GG two-way tricot knitted fabric as the cup section and wing section (the 10% warp/weft mean expansion stress being 0.4 N), with two being stacked on the outer surface of the main body. The knitted fabric of the wing section was designed for an expansion stress of 2.5 N at an elongation percentage of 20% during wear, and the sub-wing section was designed for an expansion stress of 3.5 N at an elongation percentage of 25% during wear. The length of the sub-wing section was −5% of the length of the body section at the flank reinforcer.

Example 19

A brassiere was produced in the same manner as Example 1, except for the following changes. The fabric used for the sub-wing section was a warp knitted fabric having polyester 660 dtex yarn inserted in a polyester 560 dtex chain stitch, the knitted fabric having a 10% warp/weft mean expansion stress of 210 N. The knitted fabric of the wing section was designed for an expansion stress of 2.5 N at an elongation percentage of 20% during wear, and the sub-wing section was designed for an expansion stress of 4.7 N at an elongation percentage of 3% during wear. The length of the sub-wing section was +17% of the length of the body section at the flank reinforcer.

Example 20

A brassiere was produced and evaluated in the same manner as Example 5, except that the length of the sub-wing section in Example 5 was +5% of the length of the body section of the flank reinforcer.

Comparative Example 1

A brassiere was produced in the same manner as Example 1, except that no sub-wing fabric was attached from the cup section across to the wing section. The motion of the breasts during wear was very high, vibration resistance was poor, and discomfort was experienced.

Comparative Example 2

A brassiere similar to Example 1 was produced, except that the sub-wing section was provided only on the wing section. It had a joining section between the sub-wing section and the main body at a location 33% (which is in the wing section) and a location 70% (which is in the wing section) from the bust top toward the back center of the wing section, and did not have the joining section at any location from 25% to 50% from the bust top toward the back center of the wing section, a plane S being defined matching the normal direction with respect to the direction of a line segment L connecting the bust top on one side of the cup section with the back center of the wing section. The vibration resistance against motion of the breasts during monitoring wear was inadequate.

Comparative Example 3

A brassiere similar to Example 4 was produced, except that the thickness of the strap was 1.2 mm (that is, the mean cross-sectional area was 22 $mm^2$) (i.e. no strap was provided as an anti-vibration section). The power in the lengthwise direction of the strap was 62% at the strap edge and 60% at the shoulder center section.

TABLE 1

| | Sub-wing section | Distance of sub-wing section joint from bust top (%) | Distance of sub-wing section joint from bust top (%) | Design stress of sub-wing section during wear (N) | Elongation of sub-wing section during design stress (%) | Friction between main body and sub-wing section | Reinforcing fabric of upper cup section | Stress ratio of cup upper section fabric on cup center section | Reinforcing fabric of lower cup section |
|---|---|---|---|---|---|---|---|---|---|
| Example 1 | yes | 15 | 70 | 4 | 6 | 0.13 | no | — | no |
| Example 2 | no | — | | | — | | yes | 46 | no |
| Example 3 | no | — | | | — | | no | — | yes |
| Example 4 | no | — | | | — | | no | — | no |
| Example 5 | yes | 10 | 80 | 4.5 | 40 | 0.14 | yes | 46 | no |
| Example 6 | yes | 15 | 70 | 4 | 6 | 0.13 | no | — | yes |
| Example 7 | yes | — | | | — | | no | — | no |
| Example 8 | no | — | | | — | | yes | 46 | yes |
| Example 9 | no | — | | | — | | yes | 46 | no |
| Example 10 | no | — | | | — | | no | — | yes |
| Example 11 | yes | 10 | 80 | 4.5 | 40 | 0.14 | yes | 46 | yes |
| Example 12 | yes | 10 | 80 | 4.5 | 40 | 0.14 | yes | 46 | no |
| Example 13 | yes | 15 | 70 | 4 | 6 | 0.13 | no | — | yes |
| Example 14 | yes | 10 | 80 | 4.5 | 40 | 0.14 | yes | 46 | yes |
| Example 15 | yes | 10 | 80 | 4.5 | 40 | 0.14 | yes | 46 | no |
| Example 16 | no | — | | | — | | yes | 61 | no |
| Example 17 | no | — | | | — | | yes | 25 | no |
| Example 18 | yes | 10 | 80 | 3.6 | 25 | 0.09 | no | — | no |
| Example 19 | yes | 10 | 80 | 4.7 | 3 | 0.22 | no | — | no |
| Example 20 | yes | 10 | 80 | 1.7 | 5 | | no | — | no |
| Comp. Ex. 1 | no | — | | | — | | no | — | no |
| Comp. Ex. 2 | yes | 33 | 70 | 4 | 6 | 0.13 | no | — | no |
| Comp. Ex. 3 | no | — | | | — | | no | — | no |

| | Stress ratio of cup lower section fabric on cup center section | Mean area of strap ($mm^2$) | Distance from back center of strap (%) | Power of strap center (%) | Model text motion (cm) | Motion value | Maximum wear pressure (HPa) | section not covered by structural material of brassiere among triangular | Comfort | Beauty appearance |
|---|---|---|---|---|---|---|---|---|---|---|
| Example 1 | — | 21 | 40 | 62 | 24.1 | 0.25 | 4.1 | 80 | 4.3 | 5 |
| Example 2 | — | 21 | 40 | 62 | 24.3 | 0.26 | 4.4 | 80 | 3.7 | 5 |
| Example 3 | 57 | 21 | 40 | 62 | 24.3 | 0.27 | 4.2 | 80 | 4 | 5 |
| Example 4 | — | 35 | 40 | 49 | 24.2 | 0.26 | 4 | 80 | 4.3 | 6 |
| Example 5 | — | 21 | 40 | 62 | 24.0 | 0.23 | 4 | 80 | 4.3 | 6 |
| Example 6 | 68 | 21 | 40 | 62 | 24.0 | 0.22 | 3.9 | 80 | 4.3 | 6 |
| Example 7 | — | 37 | 40 | 55 | 23.8 | 0.2 | 3.9 | 80 | 4.7 | 6 |
| Example 8 | 57 | 21 | 40 | 62 | 24.4 | 0.27 | 4.3 | 80 | 4 | 6 |
| Example 9 | — | 28 | 40 | 60 | 24.4 | 0.26 | 4.1 | 80 | 4.3 | 6 |
| Example 10 | 57 | 35 | 40 | 49 | 24.0 | 0.21 | 4 | 80 | 4.7 | 6 |
| Example 11 | 57 | 21 | 40 | 62 | 23.9 | 0.2 | 3.9 | 80 | 4.7 | 6 |
| Example 12 | — | 37 | 40 | 55 | 23.7 | 0.19 | 3.7 | 80 | 5 | 6 |
| Example 13 | 68 | 37 | 40 | 55 | 23.6 | 0.17 | 3.8 | 80 | 5 | 6 |
| Example 14 | 57 | 37 | 40 | 55 | 23.5 | 0.17 | 3.5 | 80 | 5 | 6 |
| Example 15 | — | 21 | 40 | 62 | 24.0 | 0.22 | 4 | 63 | 4.7 | 3 |
| Example 16 | — | 42 | 42 | 65 | 24.2 | 0.25 | 4.4 | 73 | 4.7 | 4 |
| Example 17 | — | 21 | 40 | 62 | 24.7 | 0.28 | 4.3 | 80 | 3.9 | 5 |
| Example 18 | — | 21 | 40 | 62 | 24.9 | 0.29 | 4.6 | 80 | 3.9 | 5 |
| Example 19 | — | 21 | 40 | 62 | 24.9 | 0.30 | 4.4 | 80 | 3.6 | 5 |
| Example 20 | — | 22 | 40 | 60 | 25.0 | 0.30 | 4.5 | 80 | 3.1 | 6 |
| Comp. Ex. 1 | — | 21 | 40 | 62 | 26.2 | 0.42 | 4.4 | 80 | 2.3 | 6 |
| Comp. Ex. 2 | — | 21 | 40 | 62 | 26.7 | 0.36 | 4.8 | 82 | 2 | 3 |
| Comp. Ex. 3 | — | 22 | 40 | 60 | 36.6 | 0.4 | 4.7 | 80 | 2 | 6 |

INDUSTRIAL APPLICABILITY

The invention can be suitably applied not only to ordinary brassieres but also to sports bras.

EXPLANATION OF SYMBOLS

1 Brassiere
101 Cup section
102 Joint
103 Wing section
103*a* Base section
103*b* Lower hem section
104 Upper edge high-stress section
105 Lower edge high-stress section
106 Center section
107 Flank reinforcer
107*a*, 107*b* Regions
107*a*S Cup section side joining section
107*b*S Wing section side joining section
108 Joined fabric
108*a* Body section
108*b* Sub-wing section
109 Strap

109*a* Shoulder

109*b* Low stress section

110 Section not covered by brassiere structural material

What is claimed is:

1. A brassiere comprising:

a pair of cup sections;

a joint linking together front center sides of the cup sections;

a wing sections; and straps having edges, the straps being connected to the pair of cup sections and the wing section at the edges, wherein the brassiere has any one of anti-vibration sections selected from the group consisting of the following (I) to (Ill):

(I) one or more selected from the group consisting of:

(1) a sub-wing section situated on a main body in a region from a portion of the cup section across to a portion of the wing section, wherein when the brassiere is situated so that a line segment extending from the bust top of the cup section to the back center of the wing section which defines the distance between the bust top and the back center is longest, and a plane is defined having a normal in same direction as the line segment, a joining section where the sub-wing section and the main body are joined, on a plane defined having a normal in same direction as the line segment at a location 5% to 25% and on a plane defined having a normal in same direction as the line segment at a location 55% to 90% on the line segment from the bust top toward the back center, and the sub-wing section has a region that is not joined to the main body, (2) an upper edge high-stress section in the cup section, the upper edge high-stress section extending along the top edge of the cup, the ratio S2/S1 of the expansion stress S2 of the upper edge high-stress section to the expansion stress S1 of the cup center section being between 2/1 and 400/1, and (3) a lower edge high-stress section in the cup section, the lower edge high-stress section extending along the cup lower edge, the ratio S3/S1 of the expansion stress S3 of the lower edge high-stress section to the expansion stress S1 of the cup center section being between 2/1 and 400/1;

(II) straps each with a mean cross-sectional area of 30 to 120 $mm^2$; and (III) a combination of (I) with straps each having a mean cross-sectional area of 25 to 120 $mm^2$.

2. A brassiere according to claim 1, wherein the anti-vibration section comprises the sub-wing section.

3. A brassiere according to claim 1, wherein the anti-vibration section comprises the upper edge high-stress section and the sub-wing section.

4. A brassiere according to claim 1, wherein the anti-vibration section comprises the lower edge high-stress section and the sub-wing section.

5. A brassiere according to claim 1, wherein the anti-vibration section comprises the strap and the sub-wing sections, and the mean cross-sectional area of the strap is 25 to 120 $mm^2$.

6. A brassiere according to claim 1, wherein the anti-vibration section comprises the upper edge high-stress section, the lower edge high-stress section and the sub-wing section.

7. A brassiere according to claim 1, wherein the anti-vibration section comprises the strap, the upper edge high-stress section and the sub-wing section, and the mean cross-sectional area of the strap is 25 to 120 $mm^2$.

8. A brassiere according to claim 1, wherein the anti-vibration section comprises the strap, the lower edge high-stress section and the sub-wing section, and the mean cross-sectional area of the strap is 25 to 120 $mm^2$.

9. A brassiere according to claim 1, wherein the anti-vibration section comprises the strap, the upper edge high-stress section, the lower edge high-stress section and the sub-wing section, and the mean cross-sectional area of the strap is 25 to 120 $mm^2$.

10. A brassiere according to claim 1, wherein when the brassiere is situated so that the distance between the cup section front center side endpoints of the straps is maximal, the proportion of an area of a section not covered by the structural material of the brassiere relative to an area of a triangle formed by connecting the cup section front center side endpoints of the straps and the center bottom edge point of the joint, is at least 60%.

11. A brassiere according to claim 1, wherein the difference between the top bust dimension and the underbust dimension is 17.5 cm or greater.

12. A brassiere according to claim 1, wherein the maximum wear pressure is no greater than 50 HPa.

13. A brassiere according to claim 2, wherein when the brassiere is situated so that the distance between the cup section front center side endpoints of the straps is maximal, the proportion of the area of the sections not covered by the structural material of the brassiere relative to the area of a triangle formed by connecting the cup section front center side endpoints of the straps and the center bottom edge point of the joint, is at least 60%.

14. A brassiere according to claim 2, wherein the difference between the top bust dimension and the underbust dimension is 17.5 cm or greater.

15. A brassiere according to claim 2, wherein the maximum wear pressure is no greater than 50 HPa.

* * * * *

UNITED STATES PATENT AND TRADEMARK OFFICE

CERTIFICATE OF CORRECTION

PATENT NO. : 9,055,771 B2
APPLICATION NO. : 14/008248
DATED : June 16, 2015
INVENTOR(S) : Junko Deguchi et al.

It is certified that error appears in the above-identified patent and that said Letters Patent is hereby corrected as shown below:

Claims

Claim 1, col. 29, line 9, "a wing sections" should read --a wing section--.

Signed and Sealed this
Nineteenth Day of January, 2016

Michelle K. Lee

Michelle K. Lee
*Director of the United States Patent and Trademark Office*